US008037941B2

(12) United States Patent
Quinlan

(10) Patent No.: US 8,037,941 B2
(45) Date of Patent: Oct. 18, 2011

(54) DUAL PACKER FOR A HORIZONTAL WELL

(75) Inventor: William C. Quinlan, Williamsburg, MI (US)

(73) Assignees: Stephen H. Anderson, Reed City, MI (US); Jordan Development Company LLC, Traverse City, MI (US); William C. Quinlan, Traverse City, MI (US)

( * ) Notice: Subject to any disclaimer, the term of this patent is extended or adjusted under 35 U.S.C. 154(b) by 0 days.

(21) Appl. No.: 12/813,034

(22) Filed: Jun. 10, 2010

(65) Prior Publication Data

US 2010/0276161 A1 Nov. 4, 2010

Related U.S. Application Data

(63) Continuation of application No. 12/116,988, filed on May 8, 2008, now Pat. No. 7,748,443.

(51) Int. Cl.
*E21B 33/12* (2006.01)

(52) U.S. Cl. ..... 166/386; 166/188; 166/327; 166/313; 166/68; 166/106

(58) Field of Classification Search ..... 166/327, 166/50, 313, 68, 106
See application file for complete search history.

(56) References Cited

U.S. PATENT DOCUMENTS

| | | | | |
|---|---|---|---|---|
| 3,399,623 | A | 9/1968 | Creed | |
| 3,765,483 | A | 10/1973 | Vencil | |
| 4,696,345 | A | 9/1987 | Hsueh | |
| 5,289,881 | A | 3/1994 | Schuh | |
| 5,607,018 | A * | 3/1997 | Schuh | 166/303 |
| 5,655,605 | A | 8/1997 | Matthews | |
| 5,771,973 | A | 6/1998 | Jensen et al. | |
| 5,931,230 | A | 8/1999 | Lesage et al. | |
| 6,039,121 | A | 3/2000 | Kisman | |
| 6,089,322 | A | 7/2000 | Kelley et al. | |
| 6,092,599 | A | 7/2000 | Berry et al. | |
| 6,257,338 | B1 | 7/2001 | Kilgore | |
| 6,601,651 | B2 | 8/2003 | Grant | |
| 6,968,893 | B2 | 11/2005 | Rusby et al. | |
| 6,973,973 | B2 | 12/2005 | Howard et al. | |
| 7,367,401 | B2 | 5/2008 | Moffett et al. | |
| 2001/0045287 | A1 | 11/2001 | Brewer | |
| 2006/0081378 | A1 | 4/2006 | Howard et al. | |

* cited by examiner

*Primary Examiner* — Daniel P Stephenson
*Assistant Examiner* — Yong-Suk Ro
(74) *Attorney, Agent, or Firm* — Young Basile

(57) ABSTRACT

A dual packer for at least partially defining a production zone in a wellbore, the dual packer including a packer body having an up-hole side and a down-hole side. A first through bore and a second through bore each extend through the packer body from the up-hole side to the down-hole side. A first piping extends from the down-hole side of the first through bore and includes a perforated sub adjacent the down-hole side of the packer body. A second piping extends from the down-hole side of the second through bore and is communicably connected to the first piping down-hole of the first perforated sub.

14 Claims, 2 Drawing Sheets

DUAL PACKER FOR A HORIZONTAL WELL

CROSS-REFERENCE TO RELATED APPLICATION

This application is a continuation of U.S. patent application Ser. No. 12/116,988, filed May 8, 2008 now U.S. Pat. No. 7,748,443 the entire contents of which are incorporated herein by reference.

FIELD OF THE INVENTION

The present invention pertains to the field of hydrocarbon wells, and more specifically to horizontal hydrocarbon wells.

BACKGROUND

Formations containing hydrocarbons are often horizontally situated. A horizontal wellbore in such a formation can provide a larger surface area in a production zone than a vertical wellbore, and as a result the horizontal formation can have a higher production rate. Additionally, horizontal wellbores can provide access to reservoirs not accessible by vertical wellbores, such as if a population is situated above the reservoir.

Hyrdocarbons in horizontal wellbores may be too dense relative to formation pressure to rise without assistance. Lift-gas can be injected to decrease the density of the hydrocarbons to enable the reservoir pressure to lift the hydrocarbons. Alternatively, pumps can be used to pump hydrocarbons to the wellhead.

SUMMARY

The present invention teaches a packer assembly for efficiently extracting hydrocarbons from a horizontal wellbore. In one embodiment, a dual packer at least partially defining a production zone is provided for a wellbore. The dual packer includes a packer body having an up-hole side and a down-hole side. First and second through bores extend between the up-hole side and down-hole sides. A first piping extends from the down-hole side of the first through bore and includes a first perforated sub. A second piping extends from the down-hole side of the second through bore, and the second piping is communicably connected to the first piping down-hole of the first perforated sub.

In another embodiment, a horizontal wellbore completion includes a dual packer, a material lifting piping, and a gas delivering piping. The dual packer is situated in a horizontal portion of the wellbore, and the dual packer includes a packer body having an up-hole side and a down-hole side. First and second through bores extend between the up-hole side and down-hole sides. A first piping extends from the down-hole side of the first through bore and includes a first perforated sub. A second piping extends from the down-hole side of the second through bore, and the second piping is communicably connected to the first piping down-hole of the first perforated sub. The material lifting piping and gas delivery piping are communicably attached to the first piping and second piping, respectively.

In a third embodiment, a completion for a horizontal wellbore includes an integral dual packer disposed in a horizontal portion of the wellbore. The dual packer at least partially defines a production zone and includes a packer body defining a first through bore and a second through bore. At least one seal circumscribes the packer body. A first piping extends through the first through bore toward the production zone, and the first piping includes a first perforated sub adjacent the packer body, an aperture, and a first plug between the first perforated sub and the aperture. A second piping extends through the second bore and toward the production zone, and the second pipe communicates with the first pipe through the aperture. An extension tubing is coupled to the first piping adjacent the aperture, and the extension tubing has a diameter within a predetermined range of a wellbore diameter. A second perforated sub and a second plug are included in the extension tubing adjacent to a toe end of the well. A production tubing and a coiled tubing are communicably attached to the first and second pipings, respectively.

BRIEF DESCRIPTION OF THE DRAWINGS

The description herein makes reference to the accompanying drawings wherein like reference numerals refer to like parts throughout the several views, and wherein.

DETAILED DESCRIPTION

Lift gas can be injected into a horizontal wellbore to decrease the density of a producing stream including water and hydrocarbons until the formation pressure is sufficient to raise the hydrocarbons. However, known lift gas injecting completions can be made more efficient. The embodiments described herein provide an efficient and low cost device for lifting hydrocarbons.

Figure 1:
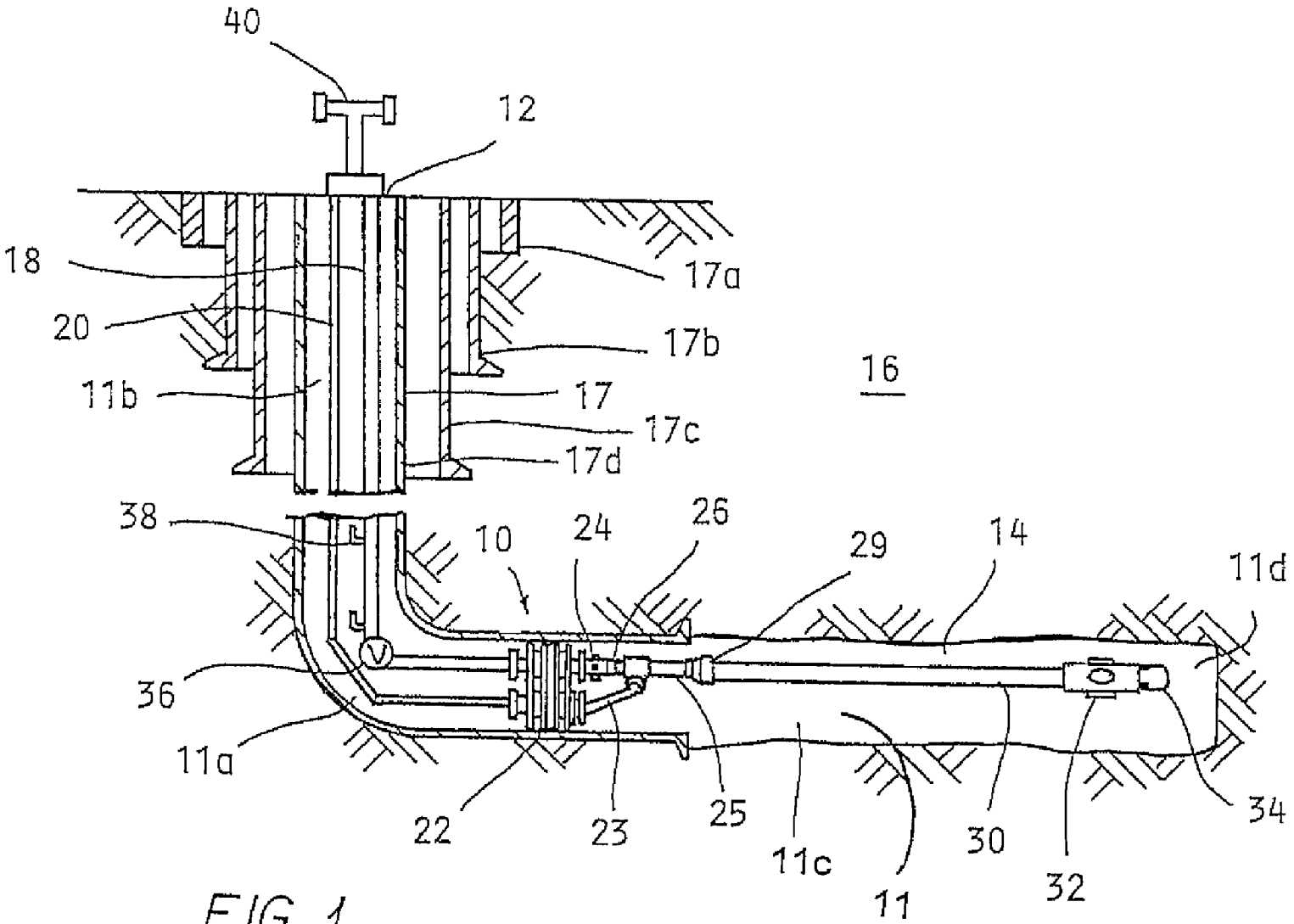
FIG. 1 illustrates a cross section of a wellbore containing an embodiment of the packer assembly.

FIG. 1 illustrates a packer assembly 10 in a wellbore 11 with a heel end 11*a* at a transition between a vertical wellbore portion 11*b* and a horizontal wellbore portion 11*c*, and a toe end 11*d* at the end of the horizontal portion 11*c*. The wellbore 11 extends from a wellhead 12 and through a production zone 14 in a formation 16. In addition to the packer assembly 10, the wellbore 11 as illustrated includes a casing 17, a production tubing 18, and a coiled tubing 20. While the illustrated wellbore 11 is a horizontal wellbore, the packer assembly 10 can be used in vertical wellbores, too.

As illustrated in FIG. 1, the casing 17 includes a series of varying diameter metal pipes cemented to the circumference of the wellbore 11. The casing 17 can include different diameter pipes for different purposes, such as the illustrated 16" conductor casing 17*a* for support during drilling, 11¾" surface casing 17*b* for isolating aquifers, 8⅝" intermediate casing 17*c* for protecting the integrity of the wellbore 11, and 5½" production casing 17*d* for enclosing components of a completion. The illustrated wellbore 11 is an openhole wellbore. Alternatively, production casing 17*d* can extend to the toe end 11*d* of horizontal portion 11*c*, in which case the casing 17*d* includes perforations in the production zone 14 to permit the entry of hydrocarbons. As an alternative to production casing 17*d* extending from the wellhead 12 to the toe end 11*d*, a liner such as a pre-holed or slotted liner can be installed in the horizontal portion 11*c*.

Figure 2:
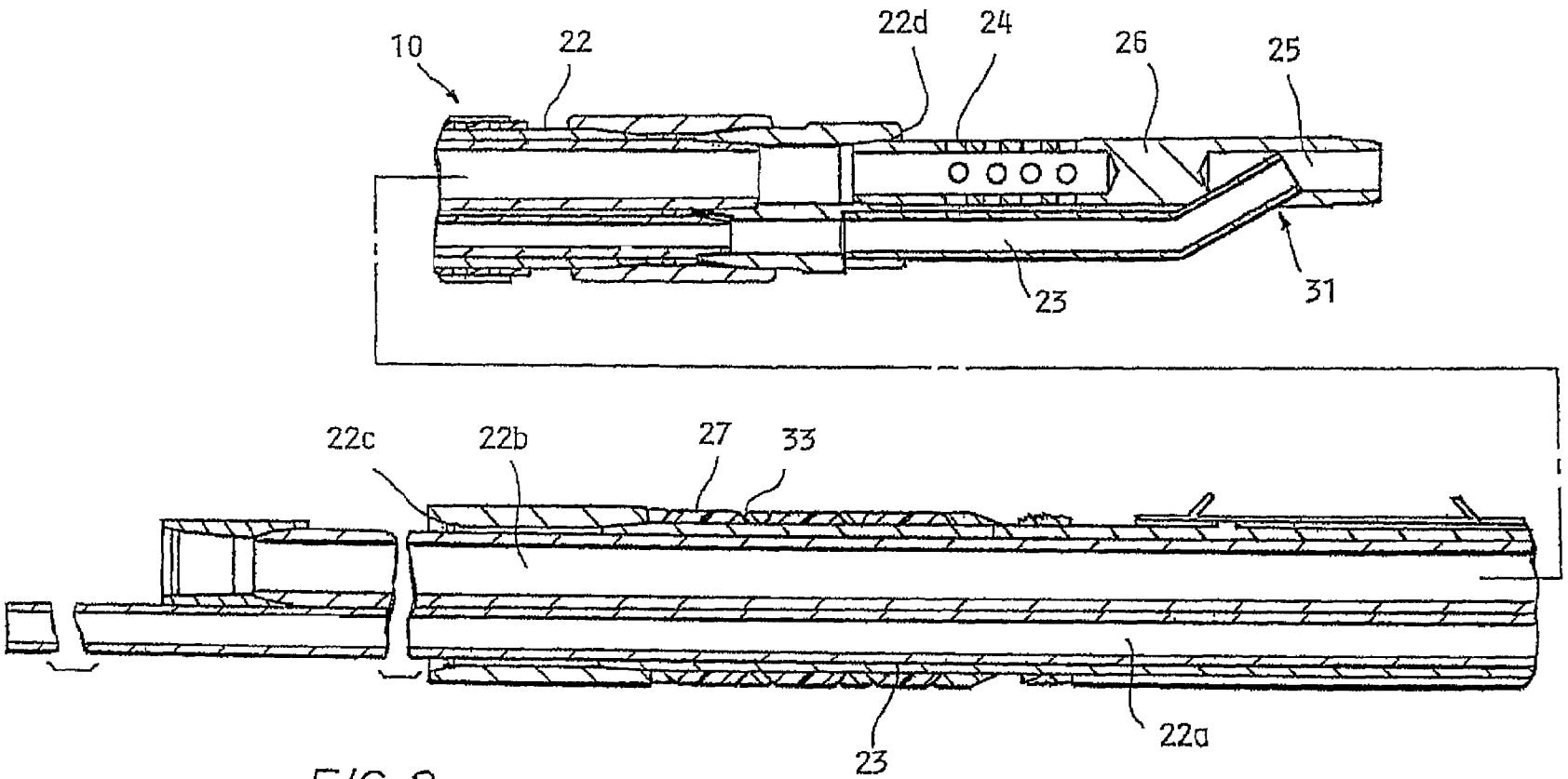
FIG. 2 illustrates a cross section of an embodiment of the packer assembly.

The packer assembly 10 is placed in the casing 17 near the heel end 11*a*. FIG. 2 illustrates a cross section of the packer assembly 10. The packer assembly 10 includes a dual packer 22, a gas connecting piping 23, a gas extension piping 25, and a piping 30. The dual packer 22 creates a seal around the inner circumference of the casing 17, separating the production zone 14 from the remaining portion of the wellbore 11. The seal as illustrated is created by multiple cylindrical rubber rings 27. The rings 27 can be braced by metal rings 33 if necessary as a result of a high pressure differential across the packer 22.

The packer 22 can be retrievable or permanent. If permanent, the packer 22 includes teeth (not shown) to secure the packer 22 in place. Alternatively, the packer assembly 10 can be located entirely or partially in the open-hole portion of a wellbore 11, in which case the seal is formed against the earth circumscribing the wellbore 11.

The packer 22 includes a first bore 22*b* and a second bore 22*a*. The bores 22*a*, 22*b* permit communication between an up-hole side 22*c* of the packer 22 and a down-hole side 22*d* of the packer 22. As illustrated, the bores 22*a*, 22*b* extend longitudinally through the packer 22. However, the bores 22*a*, 22*b* can alternatively include bends and curves.

The gas connecting piping 23 extends through the bore 22*a*. Upon exiting the packer 22 on the production zone 14 side of the packer 22, the gas connecting piping 23 and the gas extension piping 25 extend toward the toe end 11*d* from the dual packer 22. While illustrated as integral pipes, each piping 23, 25 can include multiple pipes joined together. For example, the gas extension piping 25 can include a piping section integral with the bore 22*a*, plus a second section attached to an end of the packer 22 and extending toward the toe end 11*d*. As another example, the gas connecting piping 23 can include a first pipe extending into one side of the dual packer 22 and a second pipe extending into the other side of the dual packer 22, the second pipe in communication with the first pipe.

The gas extension piping 25 includes a perforated sub 24 adjacent the packer 22, a plug 26 adjacent the perforated sub 24, and an aperture 31 adjacent the plug 26. The perforated sub 24 extends toward the production zone 14 from below the dual packer 22. The perforated sub 24 includes a plurality of apertures to accept fluid, such as a mixture of hydrocarbons, water, and gas, from the production zone 14. The apertures can be slots, holes, or similar openings capable of accepting a mixture of hydrocarbons, gas and water.

The plug 26 is included between the perforated sub 24 and the aperture 31 to prevent communication between the perforated sub 24 and the gas connecting piping 23. As illustrated, the plug 26 is a portion of the gas extension piping 25 that has not been bored away, i.e., the illustrated plug 26 and the gas extension piping 25 are formed integrally. Alternatively, the plug 26 can be a cylindrical block circumscribed by O-rings, a cylinder of metal welded to the interior of piping 25, or a similar seal to prevent lift gas from flowing from the aperture 31 to the perforated sub 24 and to prevent fluid that enters the perforated sub 24 from travelling toward the production zone 14.

The aperture 31 is adjacent the plug 26 in the gas extension piping 25. The aperture 31 permits communication between the gas connecting piping 23 and the gas extension piping 25. The aperture 31 can be a hole sized to accept the gas connecting piping 23, in which case the gas connecting piping 23 can extend into the gas extension piping 25, or the aperture 31 can be one or more smaller holes, such as perforations. The aperture 31 permits lift gas to flow from the gas connecting piping 23 into the gas extension pipe.

The gas connecting piping 23 connects to the gas extension piping 25 at the aperture 31. The gas connecting piping 23 can extend through the aperture 31 and sealingly connect to the gas extension piping 25. The gas connecting pipe 23 can include a connecting device having a structure similar to a conventional mandrel, but formed integrally with the connecting pipe 23. Alternatively, the pipes 23, 25 can be secured by a clamp, or the gas connecting piping 23 can be welded to gas extension piping 25, or a gasket can connect the two pipes 23, 25.

As illustrated, the gas extension piping 25 also includes a coupling 29 to the piping 30 extending to adjacent the toe end 11*d*. While the coupling 29 is illustrated adjacent the aperture 31, the coupling 29 can be further toward the toe end 11*d*, between the plug 26 and the aperture 31, or at any other location recognized as suitable by one of skill in the art having knowledge of the present application.

The piping 30, as illustrated, has a 2⅞" diameter. The diameter of the piping 30 can be selected to leave a small area between the piping 30 and formation 16 to force lift gas to flow turbulently through the formation 16. Turbulently flowing lift gas mixes with a greater amount of hydrocarbons than laminarly flowing lift gas, and therefore turbulent lift gas results in increased hydrocarbon recovery. The piping 30 can extend to adjacent the toe end 11*b* and include a second perforated sub 32 at the toe end 11*b* end of the piping 30 and a bull plug 34 that plugs the end of the piping 30, though the second perforated sub 32 can be located prior to adjacent the toe end 11*b* if the piping 30 does not extend to adjacent the toe end 11*b*. Alternatively, the gas extension piping 25 can extend to the toe end 11*b* of the wellbore 11 and include the second perforated sub 32 and bull plug 34. Also, the plug need not necessarily be a bull plug 34; any plug capable of sealing the piping 30 can be used. Alternatively, the end of the piping 30 need not be plugged.

The gas connecting piping 23 exits the dual packer 22 on the formation side and and extends toward the aperture 31. As illustrated, the gas connecting piping 23 bends toward the aperture 31. Alternatively, the gas extension piping 25 can be angled toward the gas connecting piping 23, both pipes 23, 25 can include a bend, or a third pipe (not shown) can extend between the gas connecting piping 23 and aperture 31.

The production tubing 18 extends from the wellhead 12, down the wellbore 11, and connects with the packer assembly 10 in communication with the perforated sub 24. The production tubing 18 as illustrated is 2⅜" diameter. Similarly, the coiled tubing 20 extends from the wellhead 12, down the wellbore 11, and connects with the packer assembly in communication with the gas connecting piping 23. The coiled tubing 20 as illustrated is 1" diameter. Alternative types and diameters of tubing can be used in place of the in place of the illustrated tubings 18, 20. For example, stick tubing of various diameters can be used in place of the coiled tubing 20.

The production tubing 18 can additionally include a seat nipple and standing valve 36 and one or more lift mandrels 38 on the up-hole side of the dual packer 22. The standing valve 36 prevents lift gas from passing through the production tubing 18 toward the packer assembly 10. The lift mandrels 38 can be used to provide additional lifting assistance to aid produced fluids in ascending the vertical portion of the production tubing 18. The lift mandrels 38 can be spring-loaded in order to open in response to a pressure in the vertical portion 11*b* of the wellbore 11. The number of lift mandrels 38 can be a function of the density and deliverability of hydrocarbons in the producing zone 14 and the formation pressure. For example, more lift mandrels 38 are necessary when the fluid density is high and the formation pressure is low than when the fluid is not dense and the formation pressure is high.

An assembly of valves 40 commonly referred to as a Christmas tree is disposed near the wellhead 12. The valves 40 can include electronic surface control valves to intermittently inject lift gas. The electronic surface control valves can be controlled based on time, tubing pressure, lift line pressure or other considerations recognizable as relevant to one of skill in the art having knowledge of the present application.

The packer assembly 10 can be formed in one piece prior to insertion into the wellbore 11. Installing a packer assembly 10 that is integral, i.e., assembled prior to insertion in the wellbore 11, reduces the number of connections that must be made down-hole. To install install the integral packer assembly 10, a first segment of the production tubing 18 and the coiled tubing 20 can be attached to the packer assembly 10 prior to insertion of the assembly 10 into the wellbore 11, and additional segments of the production tubing 18 can be attached as the assembly 10 is run into the wellbore 11. Once the packer assembly 10 is in place past the heel end of the wellbore 11*a*, the packer assembly 10 is set and the wellhead 12 is assembled to complete the installation.

In operation, lift gas, such as nitrogen, carbon dioxide, methane, an ethane higher aliphatic, hydrogen sulfide, natural gas, gas from a high pressure formation, combinations of gases, and other gases recognized by those of skill in the art as suitable, flows down the coiled tubing 20, enters the gas connecting piping 23, and flows through the aperture 31 into the gas extension piping 25. The gas then exits the piping 30 through the second perforated sub 32. The gas enters the formation 16 and mixes with hydrocarbons in the formation 16, reducing the density of the hydrocarbons. When the density of the hydrocarbons is low enough relative to the formation pressure, the hydrocarbons are transferred toward the heel end 11*a* of the wellbore 11. The hydrocarbons enter the first perforated sub 24, travel through the gas extension tubing 25 into the production tubing 18, and are transported to the wellhead 12 in the production tubing 18 with the assistance gas injected in the lift mandrels 38, if necessary, or via a pump (not shown).

The packer assembly 10 increases the efficiency of horizontal wells by transporting lift gas to the toe end 11*d* of the wellbore 11. Gas released from the second perforated sub 32 travels back toward the first perforated sub 24, mixing with hydrocarbons along the entire length of the formation 16. Thus, hydrocarbons at any location in the production zone 14 can be mixed with lift gas and swept back to the heel end 11*a* of the wellbore 11. Efficiency is increased relative to known horizontal wells because hydrocarbons at any location in the formation 16 can be exposed to lift gas and retrieved. Additionally, installation is made easier because the packer assembly 10 can be assembled outside the wellbore 11, and then inserted as one integral piece. Moreover, the junction of the gas connecting piping 23 and gas extension piping 25 provides strength, which is vital for the harsh environment in which the packer assembly 10 is placed.

The above-described embodiments have been described in order to allow easy understanding of the invention and do not limit the invention. On the contrary, the invention is intended to cover various modifications and equivalent arrangements included within the scope of the appended claims, which scope is to be accorded the broadest interpretation so as to encompass all such modifications and equivalent structure as is permitted under the law.

The invention claimed is:

1. A wellbore apparatus for use in removing hydrocarbon fluids from a wellbore positioned in a well portion angularly oriented from a vertical direction, the apparatus comprising:

a wellbore packer positioned in an angularly oriented wellbore between a wellbore surface opening and a wellbore toe portion, the packer having a first through bore for passage of fluid from down stream of the packer upstream toward the surface opening and a second through bore for passage of a lift gas downstream from the surface opening toward the wellbore toe portion;

a first pipe positioned in the wellbore in communication with the packer first through bore in fluid communication with the wellbore toe portion and the surface opening, the first pipe having a fluid inlet positioned downstream from the packer for receipt of production fluid; and a second pipe positioned in the wellbore in communication with the packer second through bore in fluid communication with the surface opening and the wellbore toe portion for transfer of the lift gas from the surface opening toward the wellbore toe portion, wherein the lift gas enters the second pipe at the surface opening at a substantially ambient temperature at the wellbore surface opening, the lift gas adapted to reduce the density of resident hydrocarbon fluids downstream of the packer without imparting appreciable thermal heat to the resident hydrocarbon fluids thereby forming a production fluid which enters the first pipe fluid inlet, the lift gas thereby artificially raising the production fluid toward the surface opening.

2. The apparatus of claim 1 wherein the lift gas is selected from the group consisting of: nitrogen, carbon dioxide, methane, ethane higher aliphatic, hydrogen sulfide and natural gas.

3. The apparatus of claim 2 wherein the lift gas is the only fluid used to mix and lower the density and hydrostatic weight of the resident hydrocarbons.

4. A method of using a dual packer for use in extracting resident fluids from a wellbore, the method comprising the steps of:

connecting a first pipe to a first through bore in a dual packer, the first pipe extending upstream from the packer toward a wellbore surface opening;

connecting a second pipe to a second through bore in the dual packer, the second pipe extending upstream and downstream of the dual packer;

inserting the dual packer into the wellbore between the wellbore surface opening and the wellbore toe end;

sealingly connecting the dual packer with the wellbore;

selecting a lift gas for use in the wellbore;

forcibly injecting the lift gas into the second pipe at the surface opening, said lift gas having a temperature that is substantially at an ambient temperature at the wellbore surface opening for delivery of the lift gas from the surface opening through the dual packer second through bore and downstream of the dual packer in a direction toward the wellbore toe end;

producing a production fluid downstream of the packer through forced interaction between the lift gas and the resident fluid; and raising the production fluid from downstream of the packer through the packer first through bore toward the surface opening using the lift gas.

5. The method of claim 4 wherein the step of selecting a lift gas comprises selecting a lift gas from the group consisting of: nitrogen, carbon dioxide, methane, ethane higher aliphatic, hydrogen sulfide and natural gas.

6. The method of claim 4 wherein the step of producing a production fluid comprises the steps of:

directly exposing the lift gas to the resident fluid in the wellbore downstream of the packer; and decreasing the density and the hydrostatic weight of the resident fluid without imparting appreciable thermal heat to the resident fluids or geologic formation thereby allowing the lift gas and resident geologic formation pressure surrounding the wellbore to forcibly raise the production fluid to the surface opening.

7. The method of claim 4 wherein the step of raising the production fluid through use of the lift gas further comprises the step of using only the lift gas to raise the production fluid from downstream of the packer in a direction upstream toward the packer and through the first through bore in the packer.

8. The method of claim 4 wherein the step of raising the production fluid through use of the lift gas further comprises the step of selectively opening mandrels positioned in the first pipe positioned upstream of the dual packer and below the surface opening for assisting the lifting of the production fluid in an upstream direction from the packer first through bore to the surface opening.

9. The method of claim 4 wherein the step of raising the production fluid through use of the lift gas further comprises the step of using a pump for assisting the lifting of the production fluid in an upstream direction from the packer first through bore to the surface opening.

10. A wellbore apparatus for use in removing hydrocarbon fluids from a wellbore positioned in a well portion angularly oriented from a vertical direction, the apparatus comprising:

a wellbore packer positioned in an angularly oriented wellbore between a wellbore surface opening and a wellbore toe portion, the packer having a first through bore for passage of fluid from down stream of the packer upstream toward the surface opening and a second through bore for passage of a lift gas downstream from the surface opening toward the wellbore toe portion;

a first pipe positioned in the wellbore in communication with the packer first through bore in fluid communication with the wellbore toe portion and the surface opening, the first pipe having a fluid inlet positioned downstream from the packer for receipt of production fluid;

a second pipe positioned in the wellbore in communication with the packer second through bore in fluid communication with the surface opening and the wellbore toe portion for transfer of the lift gas from the surface opening toward the wellbore toe portion, wherein the lift gas mixes with resident hydrocarbons downstream of the packer forming a production fluid and enters the first pipe fluid inlet to artificially raise the production fluid toward the surface opening; and an extension pipe extending downstream of the fluid inlet toward the wellbore toe portion, the second pipe sealingly and fluidly connecting to the extension pipe preventing direct injection of the lift gas into the fluid inlet before injection of the lift gas into the wellbore proximate the wellbore toe portion.

11. The apparatus of claim 10 further comprising a plug positioned between the fluid inlet and the connection of the second pipe preventing direct injection of the lift gas into the fluid inlet.

12. The apparatus of claim 10 wherein the packer is positioned in a substantially horizontal portion of the wellbore.

13. A method of using a dual packer for use in extracting resident fluids from a wellbore, the method comprising the steps of:

connecting a first pipe to a first through bore in a dual packer, the first pipe extending upstream from the packer toward a wellbore surface opening;

connecting a second pipe to a second through bore in the dual packer, the second pipe extending upstream and downstream of the dual packer;

connecting the second pipe to the first pipe downstream of the dual packer for transfer of the lift gas toward the wellbore toe end portion;

inserting the dual packer into the wellbore between the wellbore surface opening and the wellbore toe end;

sealingly connecting the dual packer with the wellbore;

selecting a lift gas for use in the wellbore;

forcibly injecting the lift gas into the second pipe for delivery of the lift gas from the surface opening through the dual packer second through bore and downstream of the dual packer in a direction toward the wellbore toe end;

producing a production fluid downstream of the packer through forced interaction between the lift gas and the resident fluid; and raising the production fluid from downstream of the packer through the packer first through bore toward the surface opening using the lift gas.

14. The method of claim 13 further comprising the step of preventing the direct injection of the lift gas to the first pipe prior to exposing the lift gas to the resident fluid.

* * * * *